US006079558A

United States Patent [19]

Yoon

[11] Patent Number: 6,079,558

[45] Date of Patent: Jun. 27, 2000

[54] WING SHAPED SECURITY DEVICE FOR GOLF BAG

[76] Inventor: Sang Youl Yoon, #20-606 Eunma Apt., 316, Kaepo-dong, Kangnam-ku, Seoul 135-240, Rep. of Korea

[21] Appl. No.: 09/111,209

[22] Filed: Jul. 7, 1998

[51] Int. Cl.[7] ..... A63B 55/00

[52] U.S. Cl. ..... 206/315.3; 206/315.6; 70/58

[58] Field of Search ..... 70/57, 58, 64, 70/59, 66; D8/333, 336, 338; 206/315.3, 315.6; 340/568.6

[56] References Cited

U.S. PATENT DOCUMENTS

| | | | |
|---|---|---|---|
| D. 361,207 | 8/1995 | Meyer . | |
| D. 366,202 | 1/1996 | Murphy . | |
| D. 366,203 | 1/1996 | Murphy . | |
| 2,133,883 | 5/1938 | Aubert | 70/58 |
| 3,996,983 | 12/1976 | Isnardi | 206/315.6 |
| 4,249,586 | 2/1981 | Setani | 206/315.4 |
| 4,538,728 | 9/1985 | Lewis . | |
| 4,860,889 | 8/1989 | Lemieux . | |
| 4,863,019 | 9/1989 | Lewis et al. . | |
| 5,004,100 | 4/1991 | Smith . | |
| 5,028,909 | 7/1991 | Miller . | |
| 5,041,815 | 8/1991 | Newton . | |
| 5,447,228 | 9/1995 | Hodgson, III | 206/315.3 |
| 5,524,753 | 6/1996 | Murphy | 206/315.6 |
| 5,590,772 | 1/1997 | Schuhlen . | |
| 5,636,735 | 6/1997 | Stusck . | |
| 5,862,909 | 1/1999 | Jacobsen | 206/315.3 |

*Primary Examiner*—Stephen P. Garbe
*Assistant Examiner*—Tri M. Mai
*Attorney, Agent, or Firm*—Baker & Daniels

[57] ABSTRACT

A wing shaped security device for a golf bag is disclosed. Wing shaped opening/closing plates are installed inside the mouth of a golf bag, and a locking member shifts the wing shaped opening/closing plates to the horizontal position or to the vertical position to close or open the mouth of the golf bag. This actuation is done within symmetrically partitioned spaces which are formed by a separating wall. According to the present invention as described above, the structure is very simple, and the structure does not protrude to the outside of the golf bag, but is contained within the golf bag. Therefore the aesthetics is neat, and the golfer will not be harmed by carrying the golf bag. Further, the golf clubs are positively locked in the bag and therefore, the expensive golf clubs will be prevented from being lost or stolen. Thus it is a safe and convenient device.

13 Claims, 4 Drawing Sheets

WING SHAPED SECURITY DEVICE FOR GOLF BAG

BACKGROUND OF THE INVENTION

1. Field of the Invention

The present invention relates to a golf bag security device. Particularly the present invention relates to a wing shaped security device for a golf bag, in which wing shaped opening/closing plates are installed inside the mouth of the golf bag, and a locking member shifts the wing shaped opening/closing plates to the horizontal position or to the vertical position to close or open the mouth of the golf bag.

2. Description of the Prior Art

There are prior art in which a lock prevents the taking-out of the clubs by locking the mouth of the golf bag.

U.S. Pat. No. 4,538,728 (dated Sep. 3, 1995) discloses a security device which is adapted for use with the upper portion of a golf club bag, and includes two semi-circular shells which are hinged to close about the mouth of the golf bag. An opening in the center of the device includes a resilient retaining member designed to clamp a set of golf clubs within the device when closed about the mouth of the golf bag. A chain ring is also mounted to the mouth of the golf bag and permits the bag to be chained to a support or stand.

In this golf bag security device, when the left and right semicircular shells are closed, the clubs are gathered to the central hole of the shell, and therefore, many clubs cannot be put into the golf bag. Further, even when the shell is open, the opening angle is narrow, and therefore, it is inconvenient to take out the clubs.

U.S. Pat. No. 4,863,019 (dated Sep. 5, 1998), discloses a golf bag lock which is intended for use in combination with a golf club bag having a mouth portion for receiving golf clubs, and comprises a pair of elongated rigid arm members for gripping one or more golf club shafts therebetween, and a rear mount having a base secured to the golf bag and an extension member hingedly mounted to the base. The arm members are hingedly mounted to the extension member to allow the arm members to swing over and away from the mouth of the golf bag, and a front mount is provided for locking the arm members in place over the golf bag. Two spaced apart posts are also provided on the front mount to form a slotted area into which the ends of the arm members may be easily placed. The front mount also includes a locking, and the free ends of the arm members have corresponding apertures through which a conventional lock may be placed to lock the arm members to the front mount. A resilient liner is also provided in centrally located recesses in the arm members to allow for first protective gripping of the golf club shafts.

In this golf bag lock, when a pair of elongated rigid arm members are locked, the golf club shaft is gripped or released between the pair of the rigid arm members. Therefore, many golf clubs cannot be accommodated. Further, the structure of the lock is complicated, and therefore, the handling is inconvenient, while the aesthetics of the lock is also not desirable.

SUMMARY OF THE INVENTION

The present invention is intended to overcome the above described disadvantages of the conventional techniques.

Therefore it is an object of the present invention to provide a wing shaped security device for a golf bag, in which the structure is simple, many golf clubs can be dispersedly accommodated, the golf clubs can be prevented from being stolen, and the external aesthetics is neat.

In achieving the above object, the wing shaped golf bag security device according to the present invention is characterized as follows. Wing shaped opening/closing plates are installed on two supporting shafts in the mouth of a golf bag to the left and right of the two shafts so as to form apertures for insertion of only the shafts of the golf clubs. At one end each of the supporting shafts, there is connected a lever which is in turn connected to a liftable plate. The liftable plate has an elongated slide hole in which an eccentric pin of a cylinder of a locking member is coupled. Thus if the locking member is turned in one direction, the two supporting shafts are turned, so that the left and right wing shaped opening/closing plates would be vertically downwardly folded, thereby opening the mouth of the golf bag.

If the locking member is turned in another direction, then the two supporting shafts are turned in the other direction, with the result that the opening closing plates shift to the horizontal position, thereby closing the mouth of the golf bag. Under this condition, only the shafts of the golf clubs are gripped in the narrow apertures, and therefore, the golf clubs cannot be taken out.

In the present invention, the wing shaped opening/closing plates move to the vertical position or to the horizontal position, thereby opening or closing the mouth of the golf bag. Therefore, the means for turning the supporting shafts is not limited to the illustration of the drawings, but other forms such as gears, levers, caps and the like can be employed.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
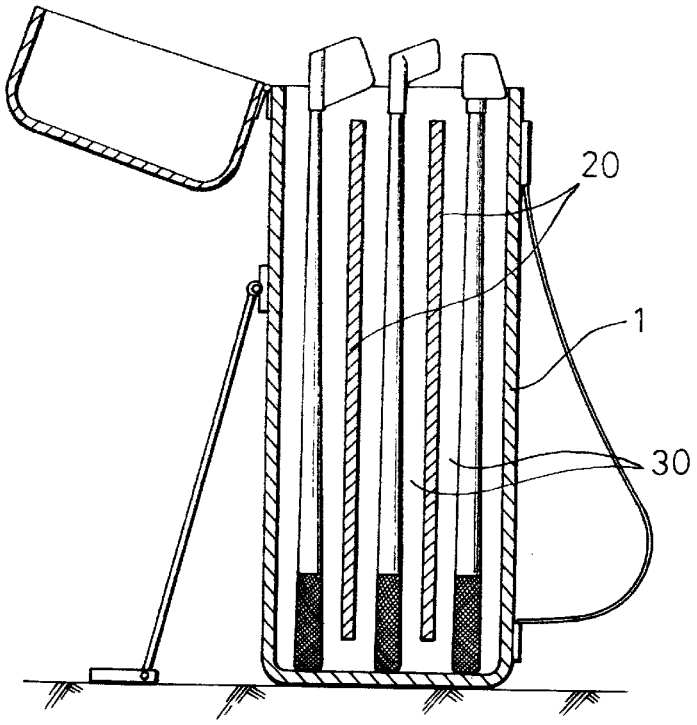
FIG. 1 is a cross sectional view of the golf bag security device according to the present invention.

FIG. 1 is an exploded perspective view of the golf bag security device according to the present invention.

Within a golf bag, a ++ shaped separating plate 2 is installed to form symmetrically partitioned spaces 3, so that golf clubs can be accommodated. Near the mouth of the golf bag 1, there are formed a pair of shaft retaining holes 4*h* and another pair of shaft retaining holes 5*h*, so that two supporting shafts 4 and 5 can be inserted. Wing shaped opening/closing plates 6 are attached to the supporting shafts 4 and 5, leaving small apertures 6*c* for receiving only the shafts of golf clubs D. The opening/closing plates 6 move to the horizontal position or to the vertical position in accordance with the turning of the supporting shafts 4 and 5. The opening/closing plates 6 are installed within the partitioned spaces 3, in such a manner that they can be shifted down to the vertical position. The two supporting shafts 4 and 5 are retained in a shaft retaining plate 7.

The front tips of the supporting shafts 4 and 5 are connected to levers 14 and 15, and the lower tips of the levers 14 and 15 are connected to links 12 and 13 which are secured on a liftable plate 10. A cylinder 9 of a locking member 8 is secured to a cover plate 11. An eccentric pin 9*p* which is formed on the cylinder 9 is inserted into an elongated slide hole 10*h* of the liftable plate 10. If a key k is inserted into a key hole of the cylinder 9 to turn the key k clockwise or counter clockwise so as to lock or release, then the supporting shafts 4 and 5 are rotated by 90 degrees clockwise or anti-clockwise by the function of the driving means which consists of the levers 14 and 15, the links 12 and 13, the liftable plate 10 and the eccentric pin 9*p* of the cylinder. Thus the wing shaped opening/closing plates are shifted to the vertical position or the horizontal position to open or close the mouth of the golf bag.

Figure 3:
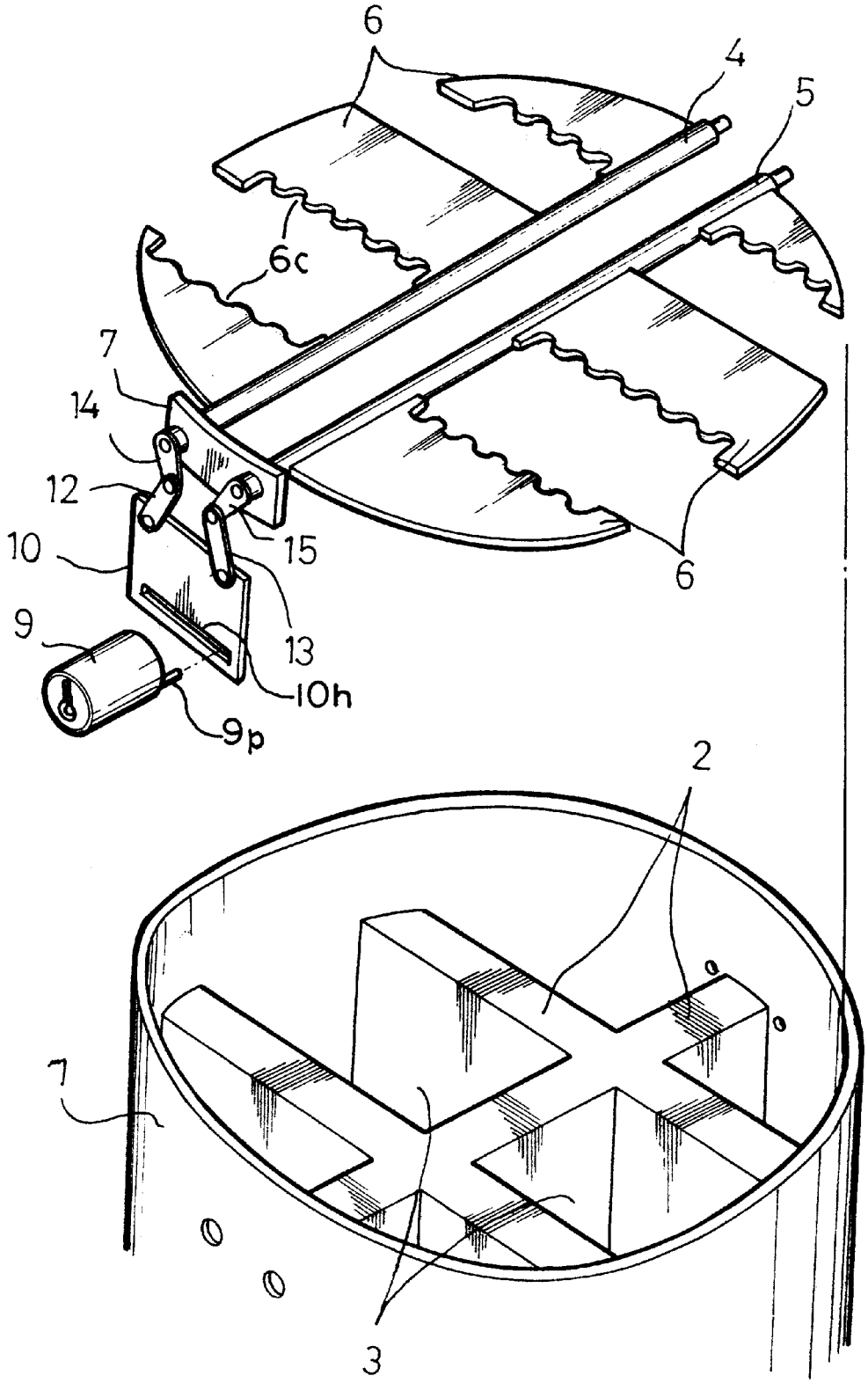
FIG. 3 is an exploded view in perspective showing the actuation of the security device.
Figure 4:
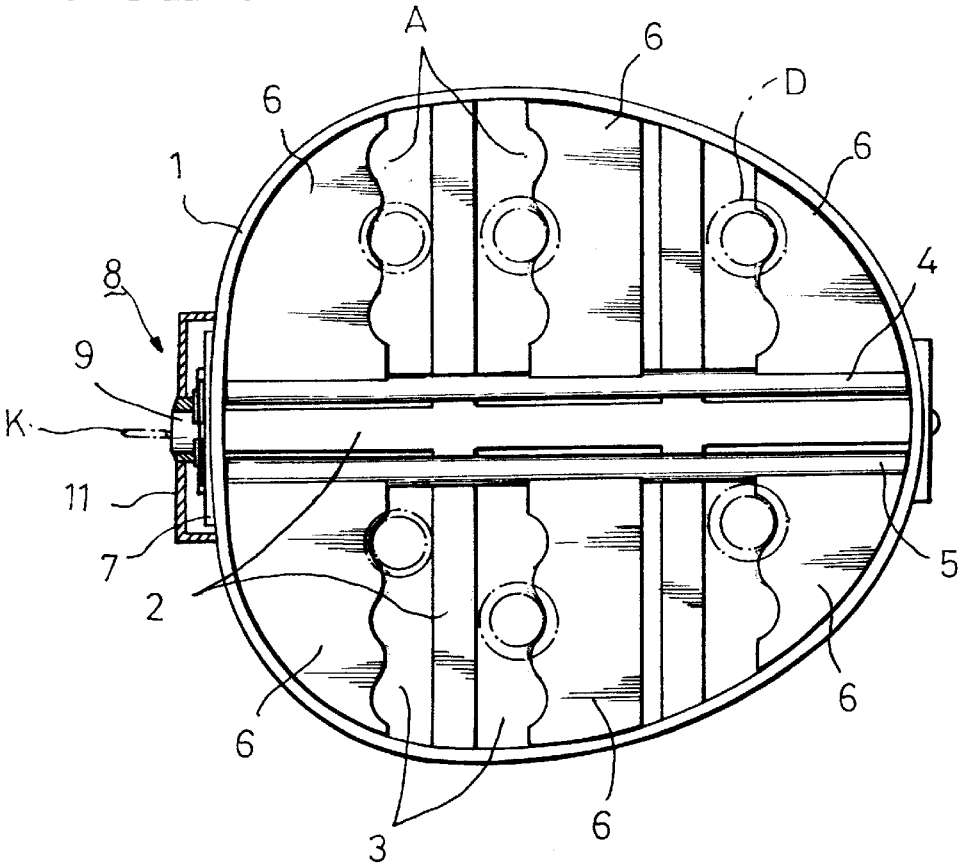
FIG. 4 is a top plan view of the golf bag security device of the present invention with the security plates in the closed position.
Figure 5:
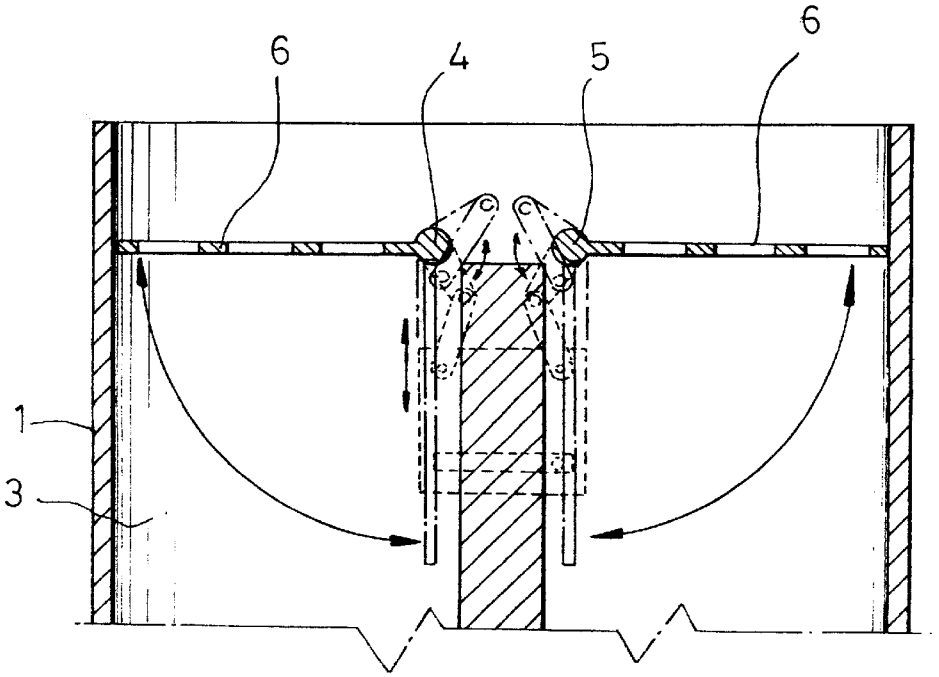
FIG. 5 is an enlarged fragmentary cross sectional view illustrating the manner in which the security plates are moved between the locked and unlocked positions.

FIGS. 3 to 5 illustrate the actuation of the security device according to the present invention.

Figure 2:
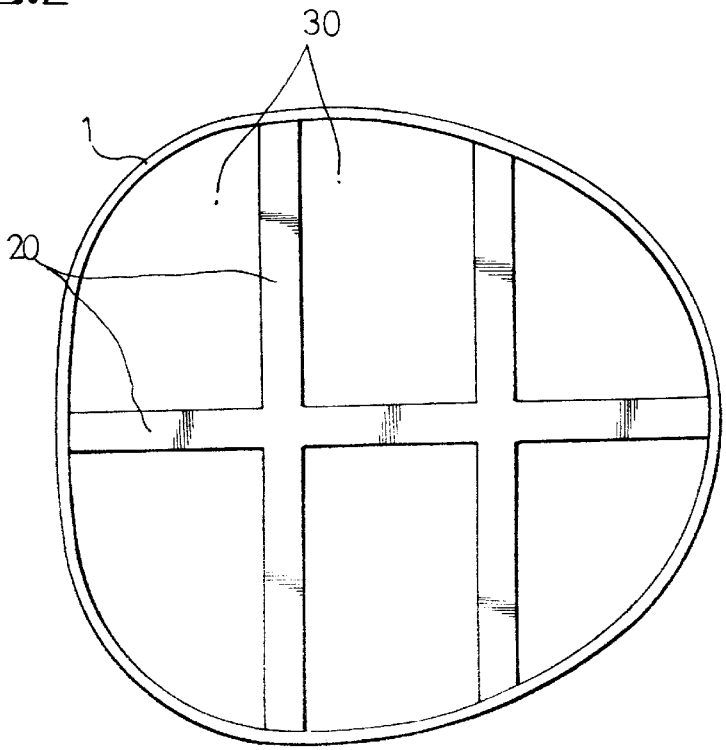
FIG. 2 is a plan view of the golf bag according to the present invention, with the security device being installed therein.

First referring to FIG. 2, when the wing shaped opening/closing plates 6 are closed to the horizontal position, the small apertures 6*c* of the opening/closing plates 6 (which are disposed within the partitioned spaces 2) accommodate the shafts of the golf clubs D. Since the apertures 6*c* are very narrow, the shafts and grips of the golf clubs cannot pass through the apertures, and therefore, in this state, the golf clubs cannot be taken out of the golf bag 1. Therefore, the golf clubs can be prevented from being lost or stolen.

When the golf bag is to be opened to take out the golf clubs, the key k is inserted into the key hole of the cylinder 9 of the locking member 8, and is turned by 180 degrees in one direction. Then the liftable plate 10 is lifted owing to the rise of the eccentric pin 9*p* as shown in the drawing, and the levers 14 and 15 are pivoted upward owing to the actuation of the links 12 and 13. The pivoting angle is about 90 degrees, and therefore, the opening/closing plates 6 which have been at the horizontal position are pivoted down by 90 degrees into the partitioned spaces 3. Thus if the left and right opening/closing plates 6 are folded into the golf bag in a symmetric manner, then the mouth of the golf bag is opened, and therefore, the golf clubs can be freely taken out.

After playing, if the golf clubs are to be stored or carried, the key k is inserted into the key hole and turned by 180 degrees in the opposite direction. Then the liftable plate 10 descends owing to the cam like actuation of the eccentric pin 9*p* and the slide hole 10*h*. Accordingly, the links 12 and 13 pull the levers 14 and 15 downward, with the result that the left and right opening/closing plates 6 are returned to the horizontal position, thereby closing the mouth of the golf bag 1. Under this condition, a slight hand manipulation is carried out so that the shafts of the golf clubs can be held in the small apertures 6*c* of the opening/closing plates 6.

Figure 6:
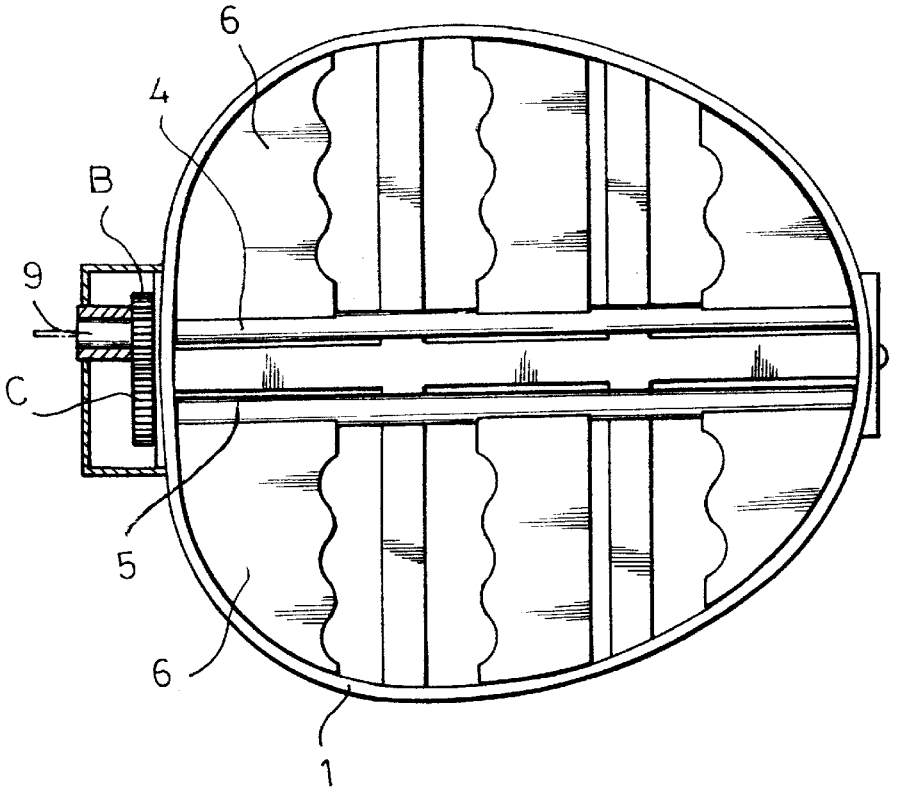
FIGS. 6 and 7 are views similar to FIGS. 4 and 5, but illustrating an alternate embodiment of the invention.
Figure 7:
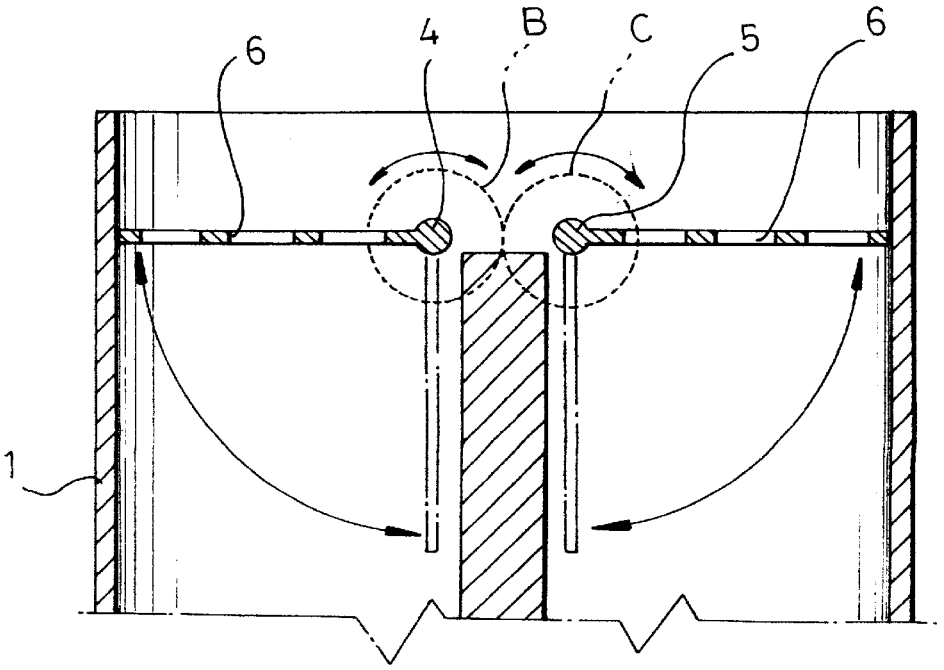

FIGS. 6 and 7 illustrate another embodiment of the driving means for the locking member, in which gears are employed. Here, a pair of gears B and C are installed at the front ends of the supporting shafts 4 and 5. The size of the gears are same with each other, and they are meshed together. If any one of the gears B and C is driven by the cylinder 9, then the meshed gears actuate symmetrically to rotate the supporting shafts so as to make the wing shaped opening/closing plates 6 pivoted to the vertical position or to the horizontal position.

In this embodiment, if the key is manipulated, the cylinder 9 directly rotates the gear B or C to the vertical position or to the horizontal position, thereby opening or closing the mouth of the golf bag.

In the above, the present invention was described based on the specific drawings, but it should be apparent to those ordinarily skilled in the art that various changes and modifications can be added without departing from the spirit and scope of the present invention as defined in the appended claims.

According to the present invention as described above, the structure is very simple, and the structure does not protrude outside of the golf bag, but is contained within the golf bag. Therefore, a neat appearance is presented, and the golfer using the bag will not be hurt when the bag is carried and therefore the golf clubs are positively locked in the bag, expensive golf clubs will be prevented from being lost or stolen. Thus it is a safe and convenient device.

What is claimed is:

1. A wing-shaped security device for a gold bag, comprising:

separating walls installed within the golf bag, for forming symmetric partitioned spaces;

a locking mechanism secured to said golf bag comprising wing-shaped opening/closing plates attached to a pair of supporting shafts in a symmetric form; and a locking member including a driving means for shifting said opening/closing plates between vertical and horizontal positions within said golf bag.

2. The wing shaped security device as claimed in claim 1, wherein narrow apertures are formed between said opening/closing plates and said separating walls.

3. The wing shaped security device as claimed in claim 1, wherein said driving means for rotating said supporting shafts of said opening/closing plates clockwise or anti-clockwise comprises: levers connected to front tips of said supporting shafts; links for actuating said levers; a liftable plate for actuating said links; and an eccentric pin formed on a cylinder for lifting or lowering said liftable plate.

4. The wing shaped security device as claimed in claim 3, wherein said liftable plate has an elongated slide hole to receive said eccentric pin of said cylinder so as to make said liftable plate move up or down through a sliding of said eccentric pin within said slide hole.

5. The wing shaped security device as claimed in claim 1, wherein said driving means for rotating said supporting shafts comprises: a pair of gears meshed together and connected to front tips of said supporting shafts and having a same size with each other; and said cylinder of said locking member is connected to any one of said gears.

6. The wing shaped security device as claimed in claim 1, further comprising two pairs of shaft retaining holes formed near a mouth of the golf bag.

7. The wing-shaped security device as claimed in claim 1, wherein said shafts are mounted in an outer peripheral wall of said golf bag.

8. A locking golf bag, comprising a golf bag having an outer covering portion, and an upper month section, partition members being positioned within said golf bag defining partitioned sections, said partition members comprising a center partition member centrally disposed within said wolf bag, and partition members extending between said center partition member and a peripheral wall of said golf bag, forming side partitioned sections, and a locking member comprised of two rotatable shafts flanking said center partition member, and at least one locking plate member being secured to, and rotatable with each said rotatable shaft, said locking members being rotatable from a locked position proximate to one of said partition members, to an unlocked position where said plate members are within said bag.

9. The locking golf bag of claim 8, wherein each said shaft includes plate members equal in number to said side partitioned sections.

10. The locking golf bag of claim 8, wherein said shafts are secured to said upper mouth section.

11. The locking golf bag of claim 10, further comprising a drive mechanism which drives said shafts between said locked and unlocked positions.

12. The locking golf bag of claim 11, wherein said drive mechanism is comprised of levers operatively connected to said shafts, said levers being driven by a keyed lock.

13. The locking golf bag of claim 11, wherein said drive mechanism is comprised of gears operatively connected to said shafts, said gears being driven by a keyed lock.

* * * * *

UNITED STATES PATENT AND TRADEMARK OFFICE

CERTIFICATE OF CORRECTION

PATENT NO. : 6,079,558

DATED : June 27, 2000

INVENTOR(S) : Sang Youl Yoon

It is certified that error appears in the above-identified patent and that said Letters Patent is hereby corrected as shown below:

Claim 1, Line 23, [gold] -- golf --

Claim 8, Line 61, [month] -- mouth --

Claim 8, Line 64, [wolf] -- golf --

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*